US006864859B1

(12) United States Patent
Ho

(10) Patent No.: US 6,864,859 B1
(45) Date of Patent: Mar. 8, 2005

(54) APPARATUS FOR INPUTTING AND DETECTING A DISPLAY DATA CHANNEL IN MANUFACTURING A MONITOR

(75) Inventor: Jae-ick Ho, Kyonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 09/280,541

(22) Filed: Mar. 30, 1999

(30) Foreign Application Priority Data

Mar. 30, 1998 (KR) ..... 98-10975

(51) Int. Cl.[7] ..... G09G 5/00
(52) U.S. Cl. ..... 345/1.1
(58) Field of Search ..... 345/1–3; 382/229, 382/313, 312; 235/462.15; 702/22

(56) References Cited

U.S. PATENT DOCUMENTS 3,665,454 A * 5/1972 Stoddard et al. ..... 345/1.1
3,868,648 A * 2/1975 Levin ..... 700/95
4,263,647 A * 4/1981 Merrell et al. ..... 700/7
5,065,360 A * 11/1991 Kelly ..... 708/142
5,109,503 A * 4/1992 Cruickshank et al. ..... 703/24
5,115,227 A * 5/1992 Keiji ..... 340/709
5,166,500 A * 11/1992 Yoon et al. ..... 235/463
5,256,973 A * 10/1993 Thee et al. ..... 324/418
5,267,178 A * 11/1993 Berner ..... 702/22
5,444,309 A * 8/1995 Innes et al. ..... 307/125
5,477,043 A * 12/1995 Dvorkis ..... 235/462
5,545,886 A * 8/1996 Metlitsky et al. ..... 235/462.42
5,726,668 A * 3/1998 Clement ..... 345/1
5,736,968 A * 4/1998 Tsakiris ..... 234/2
5,805,465 A * 9/1998 Itoh ..... 364/551.01
5,808,296 A * 9/1998 McMonagle et al. ..... 250/221
5,814,804 A * 9/1998 Kostizak ..... 235/472
5,877,745 A * 3/1999 Beeteson et al. ..... 345/156
5,923,024 A * 7/1999 Wray ..... 235/462.25
5,928,292 A * 7/1999 Miller et al. ..... 701/1
6,034,379 A * 3/2000 Bunte et al. ..... 250/566
6,035,263 A * 3/2000 Jeon ..... 702/122
6,073,848 A * 6/2000 Giebel ..... 235/462.26
6,081,261 A * 6/2000 Wolff et al. ..... 345/179
6,081,827 A * 6/2000 Reber et al. ..... 709/200
6,108,787 A * 8/2000 Anderson et al. ..... 713/201
6,122,755 A * 9/2000 Chang et al. ..... 714/25
6,230,970 B1 * 5/2001 Walsh et al. ..... 235/379
6,243,620 B1 * 6/2001 Robinson et al. ..... 700/223

* cited by examiner

*Primary Examiner*—Xiao Wu
*Assistant Examiner*—Kevin M. Nguyen
(74) *Attorney, Agent, or Firm*—Robert E. Bushnell, Esq.

(57) ABSTRACT

An apparatus, process, and method for inputting and detecting a display data channel by which data relating to a monitor is transmitted to a computer in manufacturing a monitor. The present invention includes an input device which has an automatic signal supplying element for inputting the display data channel for the monitor in a facilities for manufacturing the monitor; a driving device for driving the inputting device by a predetermined electric signal; an interfacing section for outputting a same voltage signal as an initial signal, which is switched at a different time according to a result of the input to the display data channel; and a determining device for generating a predetermined electrical signal to control the driving device and for analyzing an output signal from the interfacing section to determine whether or not the display data channel is normally input into the computer.

20 Claims, 6 Drawing Sheets

APPARATUS FOR INPUTTING AND DETECTING A DISPLAY DATA CHANNEL IN MANUFACTURING A MONITOR

This application makes reference to, incorporates the same herein, and claims all benefits accruing under 35 U.S.C. §119 from an application for Apparatus for Examining DDC Input in Product Line of Monitor for earlier filed in the Korean Industrial Property Office on the $30^{th}$ day of March 1998 and there duly assigned Serial No. 1998/10975.

BACKGROUND OF THE INVENTION

1. Field of the Invention

The present invention relates to the transmission and detection of a display data channel during the manufacture of a visual monitor, and, more particularly, to an apparatus for enhancing manufacturing productivity while concomitantly reducing unit cost by automatically inputting and detecting a display data channel during the manufacture of monitors.

2. Description of Background Art

In general, before packaging and shipping, manufacturers occasionally subject video monitors for computers to an operability test by applying and examining the visual display of data during transmission of the data via a display data channel to each of the monitors. The input of the display data channel 22 to each monitor is performed with either a scanner or a mouse, and a computer is used to detect the display data channel 22 on the monitor to which the scanner or the mouse is connected, then the monitor to be examined is connected.

Under current practice, a worker operates a scanner or a mouse in order to input the display data channel into the monitor being tested. Each monitor travelling along an assembly line is briefly stopped at a position accessible to a personal computer that serves as a test set. In order to input and detect the display data channel 22, the worker either clicks the appropriate button of a mouse or scans the bar coded information from a label (e.g., a label bearing the serial number of the monitor) that is being dispensed for application to the rear of the newly manufactured monitor. When the worker clicks the mouse, or alternatively, scans the information from the label, the data display channel 22 for the monitor is applied to the personal computer of the test set. When the data display channel 22 has been normally input into the personal computer, the personal computer drives its own monitor to visually display a message indicating that the operation has been successively completed. If the data display channel 22 is not input into the personal computer for some reason, the personal computer drives its monitor to display an error message. I have noticed, however, that in order to apply and detect the display data channel for each newly manufactured monitor, the worker must operate a mouse, or a scanner for each test of each newly manufactured monitor. Moreover, I have found that the worker must separately and visually identify the messages which are displayed on the screen of the monitor of a test set personal computer, for each monitor that travels along the assembly line. Furthermore, since the worker must operate the mouse or the scanner while visually identifying each message displayed on the monitor of the test set that corresponds to the input and detection of the data display channel 22, a substantial number of man-hours is required during each shift in order to test each newly manufactured monitor.

SUMMARY OF THE INVENTION

It is an object of the present invention to provide an improved apparatus and process for applying and detecting data transmitted to a monitor via a display data channel.

It is another object to provide an improved apparatus and process for automatically applying and detecting data transmitted to a monitor via a display data channel, during the manufacture of the monitor.

It is still another object to provide an apparatus and process able to individually test newly manufactured video monitors while minimizing the number of operational steps required during the performance of each test.

It is yet another object to provide an apparatus and process able to individually test newly manufactured video monitors while reducing the amount of time required to perform each test.

It is still yet another object to provide an apparatus and process that simplifies the testing of each newly manufactured video monitor.

The present invention has been made to overcome the above described problem of the prior art. It is an object of the present invention to provide an apparatus for inputting and detecting a display data channel while manufacturing a monitor and improving the productivity of monitors by automatically inputting and detecting a display data channel of a monitor in manufacturing the monitors, thereby reducing a manufacturing cost of the monitor.

These and other objects may be attained with an apparatus, process, and method for applying and detecting a display data channel through which data for a monitor is transmitted to a computer during the manufacture of a monitor. Embodiments of the present invention contemplate an input device that applies a display data channel for a monitor into a computer; a driver that supplies the input device with predetermined electric signals; an interface that indicates whether the display data channel for the monitor has been applied to the computer, generates the same voltage signal as an initial signal generated by the programmable logic controller, and switches the initial signal at a different time (as shown in FIG. 4) in accordance with a determination about the application of the display data channel; and a programmable logic controller that regulates the mouse/scanner driver by generating a predetermined electric signal, analyzes an output signal from the interface, and determines whether or not the result obtained by the application of the display data channel is correct.

The input device may include a mouse, a scanner and a switch to select either the mouse or the scanner, while the controller may be implemented with a programmable logic controller. The interface may be constructed with a Zener diode connected with a pin coupled to the display data channel running between the computer and the monitor; a transistor having a control electrode coupled to an output terminal of the Zener diode and turned-on and turned-off in accordance with the presence of the display data channel; a relay including a relay coil magnetized when the transistor is turned-on and first and second relay switches turned-on when the transistor is turned-off; and a light emitting diode that emits light when the first relay switch is turned-on so that the application of the display data channel can be identified. After the display data channel is applied to the computer and the interface outputs a high frequency signal, the controller is able to determine that the display data channel is normally applied to the computer when the interface outputs a signal within a first time interval. After the interfacing section continues to output the high frequency signal for a predetermined time after the first time interval, the controller determines that the display data channel is abnormally inputted into the computer if the interface outputs the signal up to a second time interval. The first time interval has a range of approximately 750 milliseconds through approximately 1.5 seconds, and the second time interval has a range of approximately 3.5 seconds through approximately 4.5 seconds.

When the display data channel is abnormally applied to the computer, the controller sounds an alarm through a loud speaker. The driver may include a relay switch (as shown in FIG. 5) coupled in parallel to a contact point for applying the display data channel of the input device and a relay coil that is magnetized by a predetermined electric signal sufficiently to operate the relay switch. After a control and detection signal is supplied to the monitor, the controller magnetizes the relay coil and turns-on the relay switch at a predetermined time so that the display data channel is applied to the monitor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
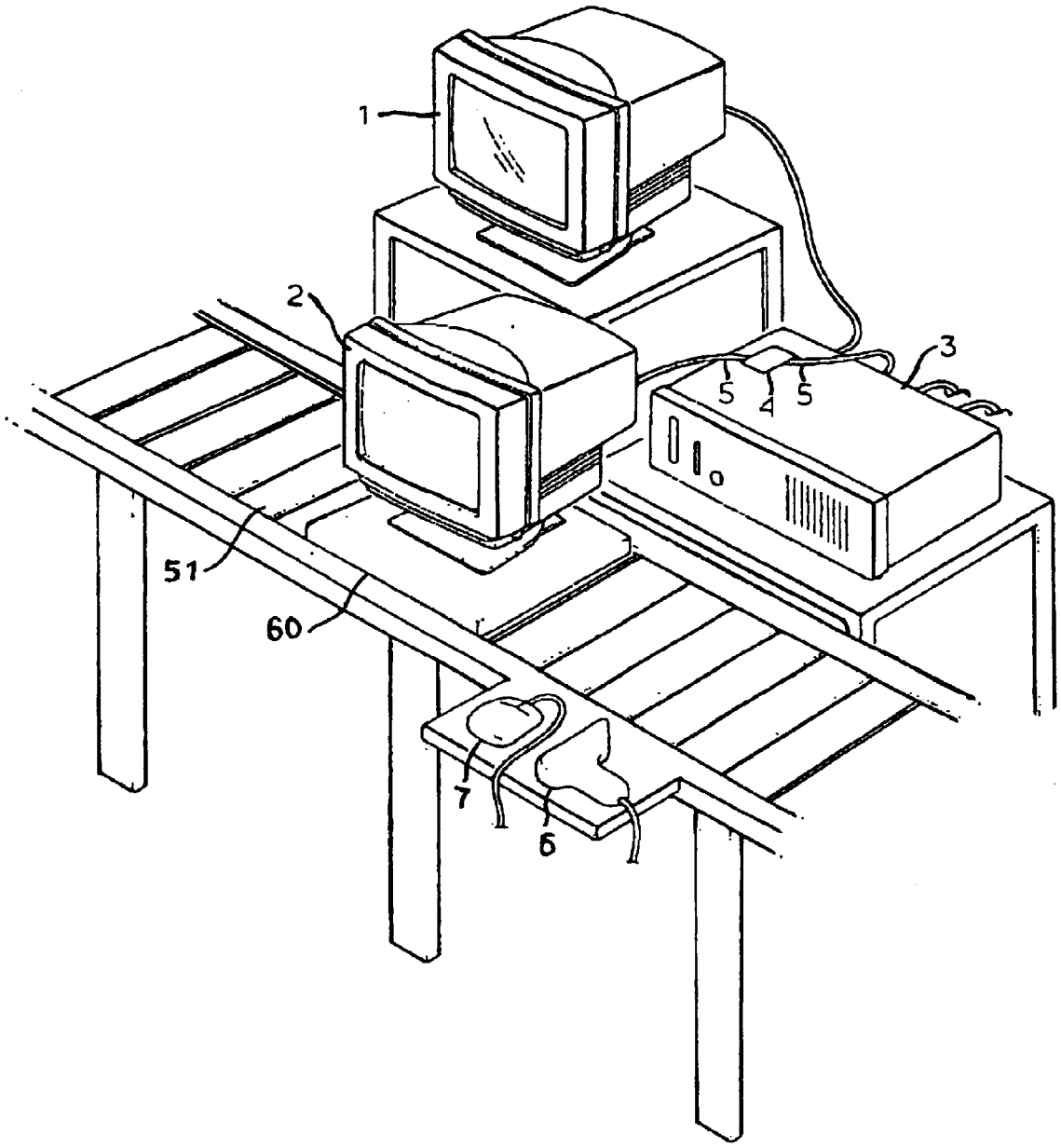
FIG. 1 is a schematic view of an apparatus dedicated to the process of determining whether a display data channel is inputted into a monitor in manufacturing monitors.

Turning now to the drawings, FIG. 1 is a schematic view of an apparatus for inputting and detecting the display data channel 22 during the manufacture of video monitors. The input and detection of the display data channel 22 using scanner 6 and mouse 7 will be described in detail below. A worker operates scanner 6 or mouse 7 so as to input the display data channel on the newly manufactured monitor 2 that is being tested, and to detect the display data channel on that monitor. The display data channel 22 is applied to a monitor 2 by use of mouse 7 while monitor 2 rides upon pallet 60 that is being carried by conveyor belt 51; conveyor belt 51 is stopped at a position that enables personal computer 3 to apply and detect the display data channel 22 on the monitor. When monitor 2 is in place and the worker clicks a corresponding button of mouse 7, the display data channel 22 for monitor 2 is received by personal computer 3 through an interface board 4. When the display data channel 22 has been normally received by personal computer 3, personal computer 3 generates a normal message, for example, a video signal corresponding to a variable visual video display on monitor 1 of the expression OK. When the DDC has been abnormally received by personal computer 3 or when interface board 4 or its cable is not properly connected to personal computer 3, personal computer 3 may generate a video signal that drives monitor 1 to visually display an error message, for example, the word ERROR or the expression NG, on its video screen.

When scanner 6 is used to apply the display data channel 22 to monitor 2, pallet 60 is stopped at a position that enables personal computer 3 to receive and detect the display data channel 22 for monitor 2. The worker uses scanner 6 to read a bar code from a label that will be attached to a back side of monitor 2. When the worker inputs information corresponding to monitor 2 into personal computer 3 by scanning the bar code from the label for monitor 2, the display data channel 22 for monitor 2 is applied to personal computer 3 through interface board 4. When the display data channel 22 has been normally received by personal computer 3, personal computer 3 generates a normal message, for example, a video signal corresponding to a variable visual video display on monitor 1 of the expression OK. When the display data channel 22 has been abnormally received by personal computer 3 or when interface board 4 or its cable is not properly connected to personal computer 3, personal computer 3 may generate a video signal that drives monitor 1 to visually display an error message, for example, the word ERROR or the expression NG, on its video screen.

Figure 2:
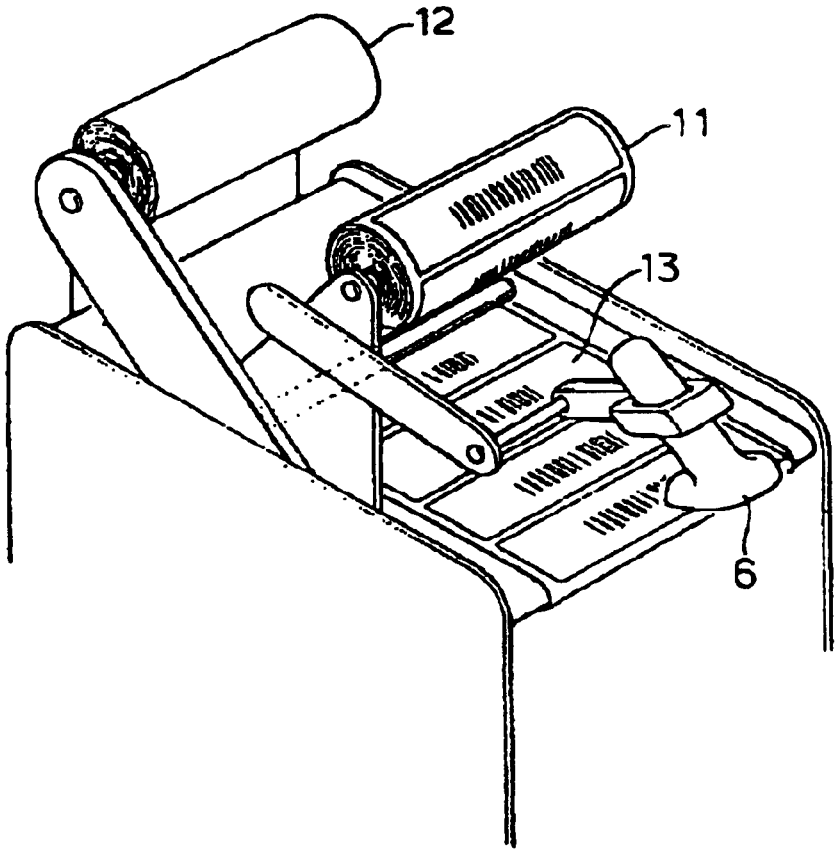
FIG. 2 is a schematic perspective view of an apparatus that uses a scanner for reading a bar code of a label that is designed to be attached to the back side of each newly manufactured monitor.

FIG. 2 is a perspective view of a device that may be used with scanner 6 to read the bar code from a label to be attached to the back side of monitor 2. The worker holds scanner 6 with one hand and positions scanner 6 to read the bar code from monitor label 13 which is carried by rollers 11 and 12. I have noticed that in order to apply and detect the display data channel to monitor 2 according to this practice, the worker must operate the mouse, or the scanner each time. Moreover, I have found a disadvantage attributable to the fact that the worker must separately, visually identify the messages which are displayed on the screen of monitor 1 of personal computer 3 for each monitor 2 that travels along conveyor belt 51. Furthermore, since the worker is required to operate mouse 6 and scanner 7, while visually identifying each message displayed on monitor 1 corresponding to the input and detection of the display data channel 22, a substantial quantity of time is required in order to test each monitor 2.

Figure 3:
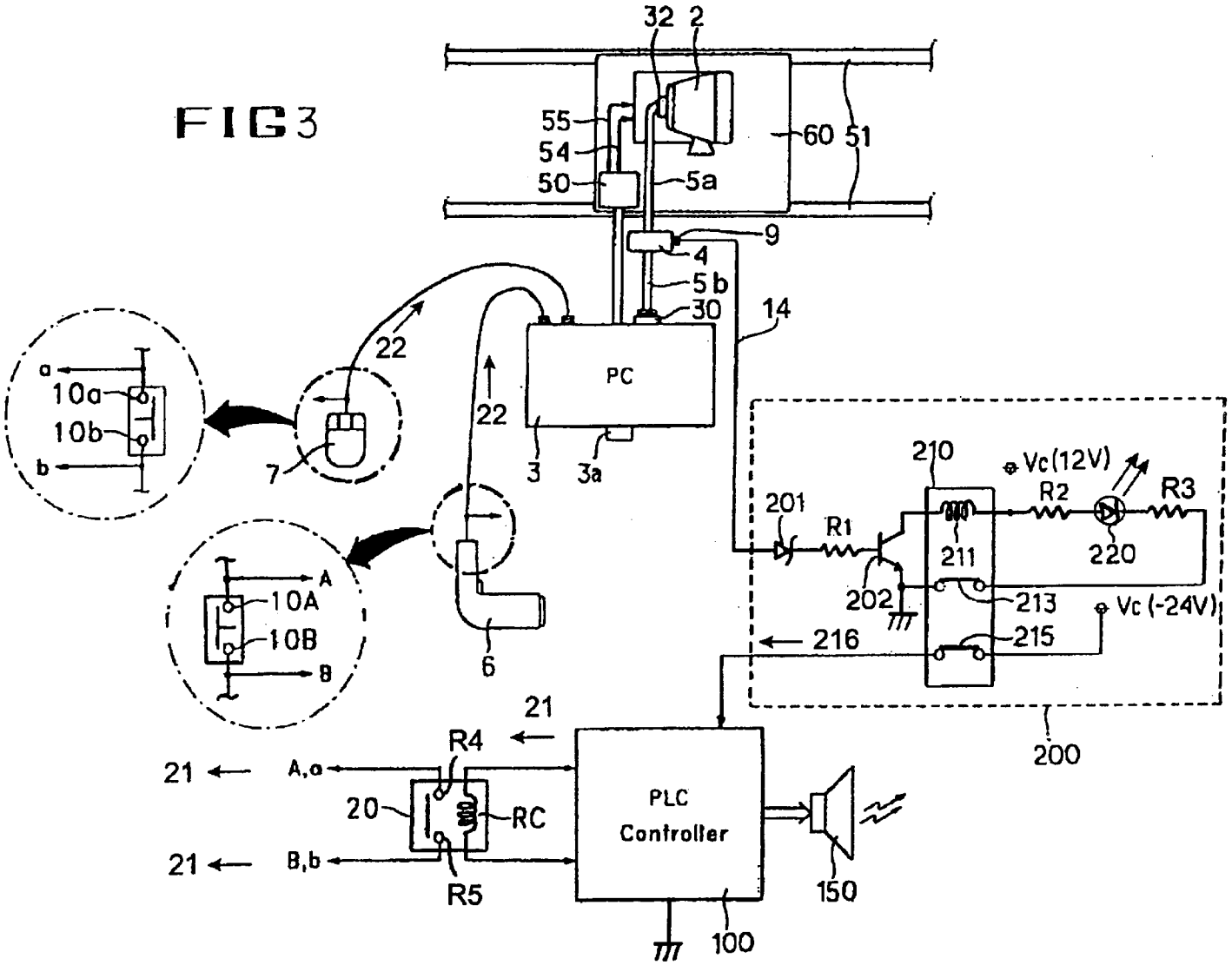
FIG. 3 is a schematic view of apparatus for applying and detecting a display data channel applied to newly manufactured monitors in accordance with the principles of the present invention.

As shown in FIG. 3, the apparatus according to the embodiment of the present invention contemplates a circuit with a mouse 7 or a scanner 6 for inputting a display data channel of a monitor 2 into a personal computer 3 which is used for examining the display data channel 22 during the manufacture of monitors; relay 20 includes switch contacts R4 and R5 which are in parallel connected with input contacts 10*a* and 10*b* of the mouse 7 or input contacts 10A and 10B of the scanner 6 and a coil RC which is magnetized by a predetermined electric signal, for example an electric signal (high frequency) outputted from a programming logic controller 100 as described below, and then connects the switch contact R4 to the switch contact R5 so that an electric current is conducted; an interfacing section 200 for indicating that the display data channel 22 of the monitor 2 is inputted into the computer 3 and for outputting an initial signal and the same signal which is switched at a different time as that of generating the initial signal according to a result of inputting the display data channel 22; the programming logic controller 100 for generating a signal magnetizing the coil RC forming the relay 20 so as to electrically connect the switch contact R4 to the switch contact R5, for enabling the display data channel 22 to be input into the personal computer 3; and for determining whether the inputting of the display data channel 22 is normal or abnormal by using a determination of the difference of frequencies and switching times between interfacing section 200 and programmable logic controller 100.

As shown in FIG. 3, the interfacing section 200 according to the present invention includes a Zener diode 201 which is connected with pins of ports 30 and 32 to connect the personal computer 3 to the monitor 2; a transistor 202 which has a base terminal connected to an output terminal of the Zener diode 201 and which is turned-on or turned-off based on the presence of the display data channel 22; a relay 210 for including a relay coil 211 magnetized when the transistor 202 is turned-on and first and second relay switches 213 and 215 which are turned-on when the relay coil 211 is not magnetized; a light emitting diode 220 for emitting light when an electric current is applied to the first switch, i.e. when the display data channel 22 is inputted into the monitor 2, so that it is identified to input the display data channel 22 into the monitor 2; and resistors R1, R2, and R3 for regulating current. When the second switch 215 is turned-on, voltage (−24V) for driving the programmable logic controller 100 is applied to the programmable logic controller 100.

With respect to FIG. 3, reference numeral 50 indicates a signal supplying device for supplying signals to examine the monitor 2.

Hereinafter, the operation of the apparatus to input and detect the display data channel 22 in manufacturing the monitors according to the present invention will be described in detail with reference to FIGS. 3 through 6. When monitor 2 is placed at a position to be examined and adjusted in the facility for producing the monitor 2, the signal supplying device 50 supplies signals for examining and adjusting the monitor 2, for example horizontal synchronization signal and vertical synchronization signal, through a signal cable 55, a microprocessor cable 54, and the like to the monitor 2.

That is, when examining and adjusting the monitor 2, a worker places a pallet 60 on a conveyer belt 51 and positions the monitor 2 to be examined on the pallet 51. When operating the conveyer belt 51, the pallet 60 having the monitor 2 thereon is carried by the conveyer belt 51. The pallet 60 is stopped at a position where the signal supplying device 50 is disposed by a detent 57 installed at the center portion of the conveyer belt 51.

The microprocessor cable 54 and the signal cable 55 are connected to an assembly of a printed circuit board in the monitor 2 at one end thereof and is in automatic and manual contact with connecting devices, such as a micro processor jack 58 and a signal jack 59 of the signal supplying device 50 which are fixed to a frame of the conveyer belt 51 at the other ends thereof.

As described above, when the micro processor cable 54 and the signal cable 55 are connected to the connecting devices fixed to the frame of the conveyer belt 51, signals for examining and detecting the monitor 2 (e.g., the horizontal synchronization signal and the vertical synchronization signal) are supplied through the combination cable 56 from the signal supplying device 50 to the assembly of the printed circuit board 2*b*.

The signals for examining and detecting the monitor 2 are processed in the assembly 2*b* of the printed circuit board and indicated on the monitor 2 so that the worker can identify the result of examining and detecting the monitor 2 to adjust the display data channel 22 of the monitor 2.

After the signal supplying device 50 supplies the signals for adjusting and examining the monitor 2 for the monitor 2, the programmable logic controller 100 magnetizes the coil RC of the relay 20 and turns-on contacts R4 and R5. That is, the PLC 100 turns on the relay 20 automatically after the signal supplying device 50 supplies the signals for adjusting and examining the monitor 2 for the monitor 2. Even though the worker did not push a switch button of the mouse 7 or the scanner 6, the PLC 100 can input the display data channel 22 into the monitor 2.

As described above, the contacts R4 and R5 of the relay 20 are electrically connected with each other to make the display data channel 22 to be inputted into the monitor 2 as the contacts R4 and R5 of the relay 20 are in parallel connected with the start contacts 10*a* and 10*b* of the mouse start contacts 10A and 10B of the scanner 6.

Figure 5:
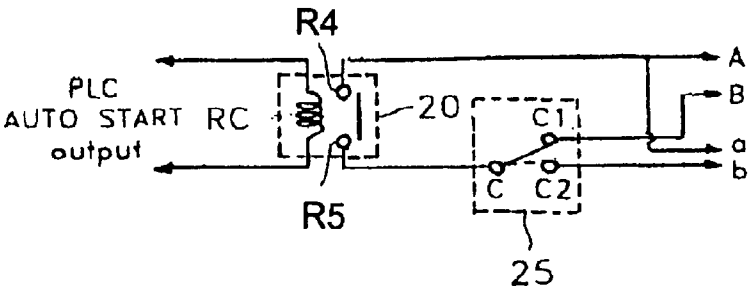
FIG. 5 is a view showing the construction of a circuit that may be used to selectively connect a mouse or a scanner during the practice of the present invention.
Figure 6:
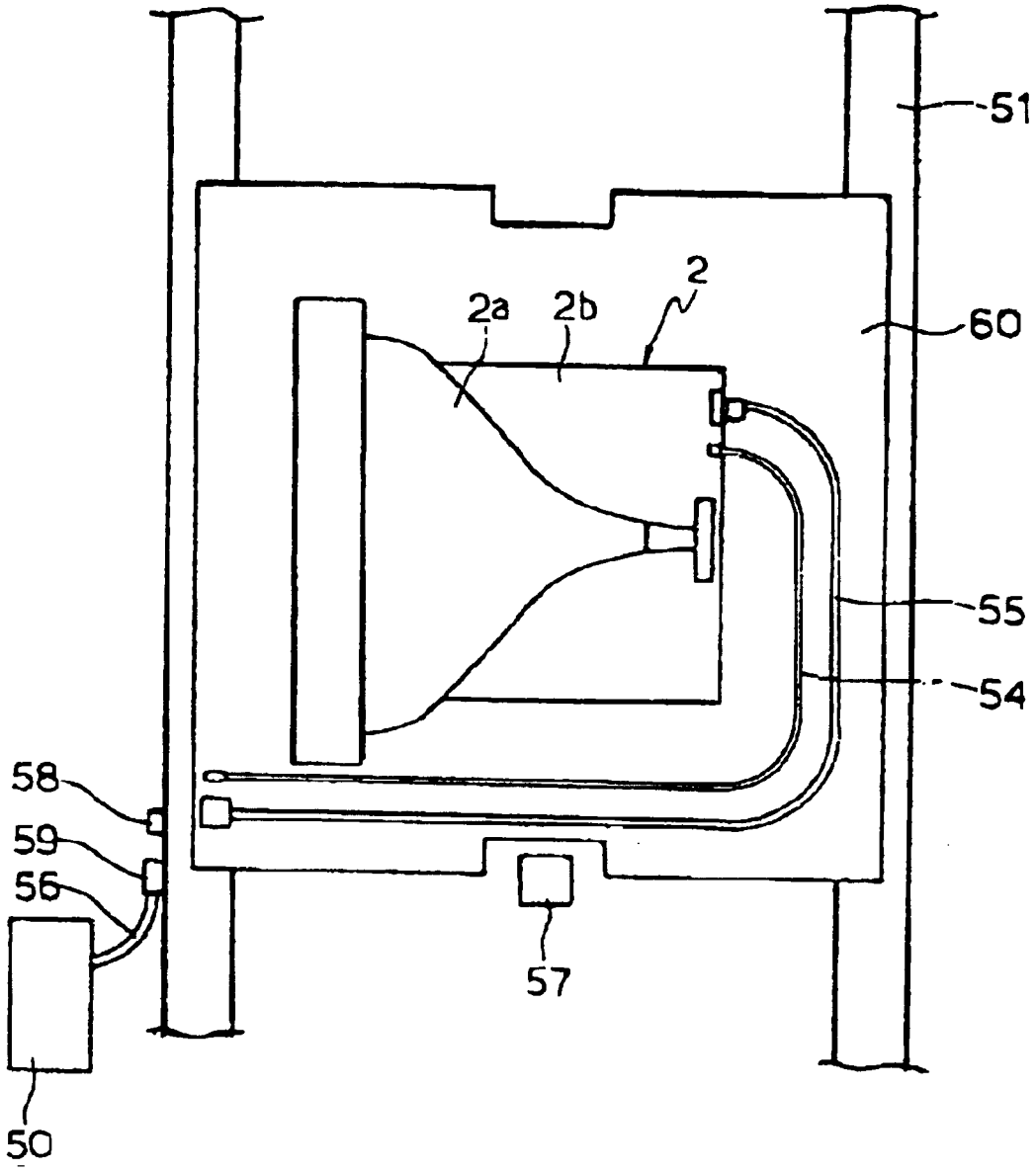
FIG. 6 is a schematic view of a conveyer system dedicated to transporting newly manufactured monitors during fabrication and testing.

Since the input of the display data channel 22 can be accomplished by operating the mouse 7 or the scanner 6, the contacts R1 and R2 of FIG. 5 are preferably connected to a selecting switch 25 in order to select either the mouse 7 or the scanner 6. That is, when a contact C of the selecting switch 25 is electrically connected to a contact C1 of the selecting switch 25, the contacts R4 and R5 of the relay 20 function as a click contact of the mouse 7. On the other hand, when the contact C of the selecting switch 25 is electrically connected to a contact C2 of the selecting switch 25, the contacts R4 and R5 of the relay 20 function as a reading contact of the scanner 6.

When the display data channel 22 is inputted into the monitor 2 in such a manner as described above, a low voltage signal is applied to the Zener diode 201 of the interfacing section 200 connected to display data channel 22 pin 9 via connector 14 to turn-off transistor 202, turn-on LED 220 via switch 213, and supply an output signal to programmable logic controller 100 via switch 215. In the other words, when the contacts R4 and R5 of the relay 20 are electrically connected to each other so that the display data channel 22 is input into the monitor 2, the low voltage signal (about 1.5 volts) is applied to the interfacing section 200 to turn-off the transistor 202, whereas when the contacts R4 and R5 of the relay 20 are electrically released from each other so that the display data channel 22 is not inputted into the monitor 2, a high voltage signal (about 5 volts) is applied to the interfacing section 200 to turn-on the transistor 202, turn-off LED 220, and drive the signal to ground via relay coil 211.

If the display data channel 22 is input into the monitor 2 and the transistor 202 is turned-off, the first and second switch contacts 213 and 215 are held turned-on as the relay coil 211 is not magnetized. This is the reason that the contact switches 213 and 215 of the relay 210 of the interfacing section 200 are a relay in contact B which is held turned-on when the relay coil 211 is not magnetized and is turned-off when the relay coil 211 is magnetized.

If the display data channel 22 is input into the monitor 2, which in turn turns-off transistor 202, the light emitting diode 220 is turned on as a closed circuit is formed in the interfacing section 200, in which the electric current is discharged at an earth by way of the light emitting diode 220 and the first contact switch 213. If the display data channel 22 is not input into the monitor 2 and transistor 202 is turned on, the light emitting diode 220 is turned off as the electric current is discharged at the earth by way of the coil of the relay 210 in the interfacing section 200 and the first contact switch 213 of the relay 210 is turned off. Accordingly, the worker identifies the light emitting diode 220 when transistor 202 is turned off to determine whether or not the display data channel 22 is input into the monitor 2.

When the contacts R4 and R5 of the relay 20 are turned-on according to the control of the PLC 100 and the display data channel 22 is normally input into the monitor 2, the PLC 100 analyzes the signal outputted from the interfacing section 200 to determine whether or not the display data channel 22 is normally inputted into the monitor 2.

Figure 4A:
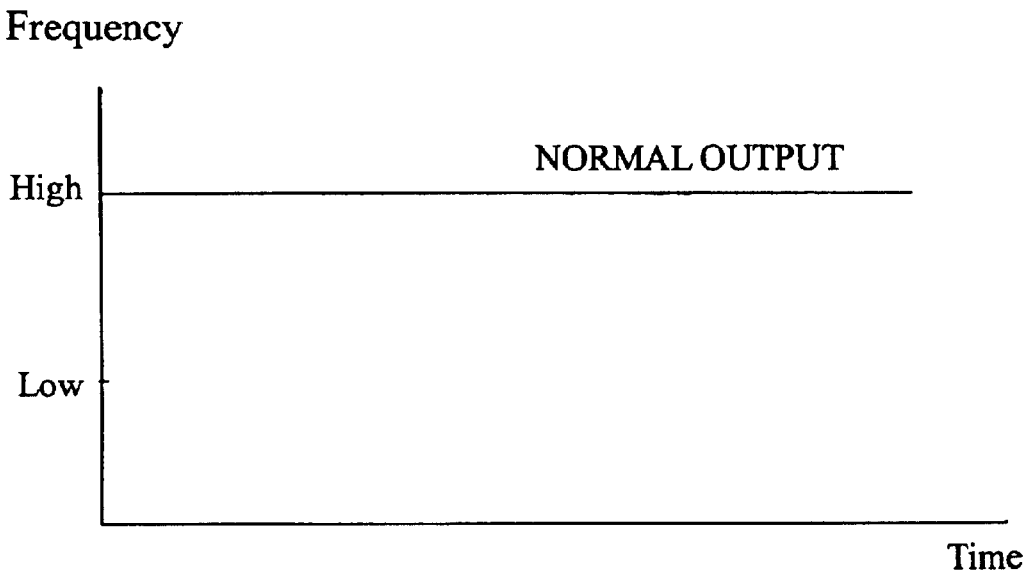
FIGS. 4A–4C are views showing the waveform of output signals obtained from the input of the display data channel to newly manufactured monitors.
Figure 4B:
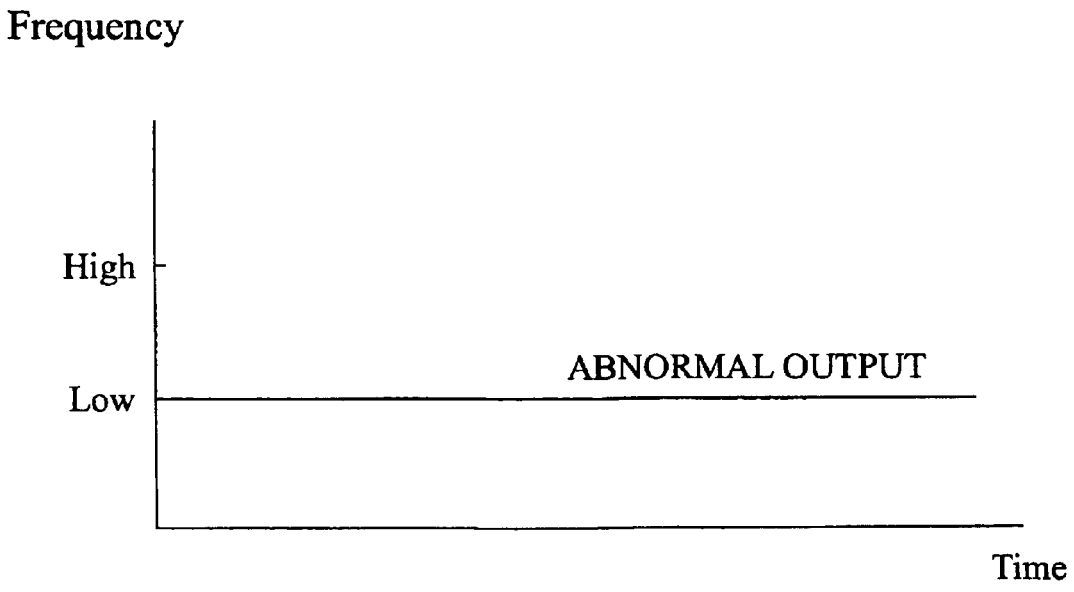
Figure 4C:
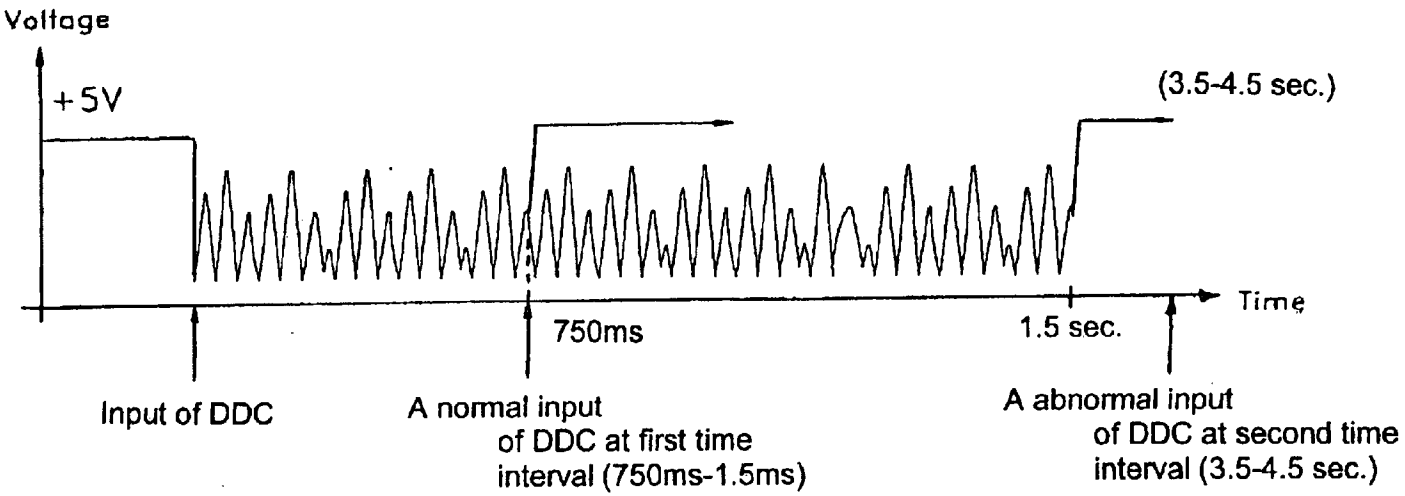

As shown in FIG. 4, switching times when the input of the display data channel 22 is normal are different from that when the input of the display data channel 22 is abnormal after the display data channel 22 is inputted into the monitor 2. When the input of the display data channel 22 is normal, the switching times between interface 200 and programmable logic controller 100 are in a range of approximately 750 milliseconds to approximately 1.5 seconds, while when the input of the display data channel 22 is abnormal, the switching times are in a range of approximately 3.5 seconds to approximately 4.5 seconds.

Accordingly, the signal outputted from interfacing section 200 is identified at first and second times by programmable logic controller 100. If a high frequency signal is output from interfacing section 200 at the same frequency as the inputted predetermined electric signal 21 from programmable logic controller 100, the input of the display data channel 22 is normal. Otherwise, if the output signal from interfacing section 200 is at a lower frequency than the inputted predetermined electric signal, the input of the display data channel 22 is abnormal.

Embodiments of the present invention permit sequences of testing to be programmed into programmable logic controller 100 programmable logic controller 100 is able to broadcast an alarm via loudspeaker 150 whenever it determines that an input of the display data channel 22 is abnormal.

According to the principles of the present invention, the input and examination of the display data channel 22 in manufacturing the monitors are automatically carried out so that it is unnecessary for the input and examination of the display data channel 22 to be operated by a mouse 7 and a scanner 6 when the monitor is identified by the worker after carrying out the input and examination of the display data channel 22. As described in the foregoing paragraphs, the apparatus to input and detect the display data channel 22 in manufacturing the monitors according to the present invention is capable of improving a productivity of monitors by automatically inputting and detecting a display data channel of a monitor in manufacturing the monitors, thereby reducing a manufacturing cost of the monitor. The difference between the present invention and the conventional art and the advantages of the present invention will be apparent with reference to a table below.

TABLE 1

| | conventional art | | present invention | |
|---|---|---|---|---|
| | input of DDC | detecting of DDC | input of DDC | detecting of DDC |
| How to operate | manual operation by using a scanner or mouse | | automatic operation by using a PLC | |
| identification of the operation | worker identifies the operation with observation | | worker identifies the operation with LED | |
| when errors are generated | Worker identifies messages of a monitor with observation during the operation (impossible immediate response) | | Alert by means of an alarm (possible immediate response) | |
| times for operation | about 5 sec | about 2 sec | 0 | |

While the present invention has been particularly shown and described with reference to a particular embodiment thereof, it will be understood by those skilled in the art that various changes in form and detail may be effected therein without departing from the scope of the invention as defined by the appended claims. For example, although these principles have been illustrated for the manufacture of cathode ray type monitors, the present invention may be practiced during the test of any type of monitor, such as, by way of example, a flat panel display or a liquid crystal display.

What is claimed is:

1. An apparatus, comprising:

an inputting device inputting a display data channel of a monitor into a computer;

a driving device driving the inputting device with a predetermined electric signal;

an interfacing section indicating whether the display data channel of the monitor is inputted into the computer and outputting a voltage signal reflective of an originally inputted voltage signal, the outputted voltage signal is switched at a different time according to a result of inputting the display data channel; and a controller for controlling the driving device by generating the predetermined electric signal, for analyzing the output signal from the interfacing section, and for determining whether or not the result of inputting the display data channel is correct.

2. An apparatus as claimed in claim 1, wherein the inputting device includes a mouse.

3. An apparatus as claimed in claim 1, wherein the inputting device includes a scanner.

4. An apparatus as claimed in claim 1, wherein the controller for the controlling and determining includes a programmable logic controller.

5. An apparatus as claimed in claim 1, wherein the inputting device includes a mouse and a scanner and further comprises a switch to select one of the mouse and the scanner.

6. An apparatus, comprising:

an inputting device inputting a display data channel of a monitor into a computer;

a driving device driving the inputting device with a predetermined electric signal;

an interfacing section indicating whether the display data channel of the monitor is inputted into the computer and outputting a voltage signal reflective of an originally inputted voltage signal, which is switched at a different time according to a result of inputting the display data channel; and a controller for controlling the driving device by generating the predetermined electric signal, for analyzing the output signal from the interfacing section, and for determining whether or not the result of inputting the display data channel is correct, wherein the interfacing section comprises:

a Zener diode connected with a pin of the display data channel, the display data channel connects the computer and the monitor;

a transistor having a base connected to an output terminal of the Zener diode and being turned-on and turned-off according to a presence of the display data channel;

a relay including a relay coil magnetized when the transistor is turned-on and a first and second relay switches turned-on when the transistor is turned-off; and a light emitting diode for emitting light when the first relay switch is turned-on to identify the inputting of the display data channel.

7. An apparatus, comprising:

an inputting device inputting a display data channel of a monitor into a computer;

a driving device driving the inputting device with a predetermined electric signal;

an interfacing section indicating whether the display data channel of the monitor is inputted into the computer and outputting a voltage signal reflective of an originally inputted voltage signal, which is switched at a different time according to a result of inputting the display data channel; and a controller for controlling the driving device by generating the predetermined electric signal, for analyzing the output signal from the interfacing section, and for determining whether or not the result of inputting the display data channel is correct, wherein after the display data channel is inputted into the computer and the interfacing section outputs a high frequency signal, the controller determines that the display data channel is normally inputted into the computer if the interfacing section outputs the same signal as the initial signal at a first time, and after the interfacing section continues to output the high frequency signal for a predetermined times after the first time, the controller determines that the display data channel is abnormally inputted into the computer if the interfacing section outputs the same signal as the initial signal at a second time.

8. An apparatus as claimed in claim 7, wherein the first time is in a range of 750 milliseconds to 1.5 seconds, and the second time is in a range of 3.5 seconds to 4.5 seconds.

9. An apparatus as claimed in claim 7, wherein when the display data channel is abnormally inputted into the computer, the controller for the controlling and determining raises an alarm by an alarm generating device.

10. An apparatus, comprising:

an inputting device inputting a display data channel of a monitor into a computer;

a driving device driving the inputting device with a predetermined electric signal;

an interfacing section indicating whether the display data channel of the monitor is inputted into the computer and outputting a voltage signal reflective of an originally inputted voltage signal, which is switched at a different time according to a result of inputting the display data channel; and a controller for controlling the driving device by generating the predetermined electric signal, for analyzing the output signal from the interfacing section, and for determining whether or not the result of inputting the display data channel is correct, wherein the driving device includes a relay switch, the relay switch is in parallel connection to a contact point for inputting the display data channel of the inputting device and the relay coil magnetized by the predetermined electric signal to operate the relay switch.

11. An apparatus as claimed in claim 10, wherein after a controlling and detecting signal for the monitor is supplied, the controller for the controlling and detecting magnetizes the relay coil and turns-on the relay switch at a predetermined time thereafter to input the display data channel into the monitor.

12. A method, comprising:

inputting a display data channel to a monitor by an inputting device;

driving said inputting device with a predetermined electric signal by a driving device;

indicating whether said display data channel of said monitor is inputted into said computer and outputting a signal according to a result of said inputting by an interfacing section, said interfacing section outputting a voltage signal reflective of an originally inputted voltage signal, which is switched at a different time according to a result of inputting the display data channel;

controlling said driving device by generating said predetermined electric signal;

analyzing said output signal from said interfacing section; and determining whether said result of said inputting said display data channel is correct.

13. A method as claimed in claim 12, with said inputting device including a mouse.

14. A method as claimed in claim 12, with said inputting device including a scanner.

15. A method as claimed in claim 12, with said controlling and determining including a programmable logic controller.

16. A method, comprising:

inputting a display data channel to a monitor by an inputting device;

driving said inputting device with a predetermined electric signal by a driving device;

indicating by an interfacing section, whether said display data channel of said monitor is inputted into said computer and outputting by said interfacing section, a signal according to a result of said inputting said display data channel;

controlling said driving device by generating said predetermined electric signal;

analyzing said output signal from said interfacing section; and determining whether said result of said inputting said display data channel is correct, with said controlling and determining including a programmable logic controller, with said programmable logic controller magnetizes a relay coil of said driving device and turns-on a relay switch of said driving device to input said display data channel to said monitor.

17. A method, comprising:

inputting a display data channel to a monitor by an inputting device;

driving said inputting device with a predetermined electric signal by a driving device;

indicating whether said display data channel of said monitor is inputted into said computer and outputting a signal according to a result of said inputting said display data channel by an interfacing section;

controlling said driving device by generating said predetermined electric signal;

analyzing said output signal from said interfacing section; and determining whether said result of said inputting said display data channel is correct, with said interfacing section comprising:

connecting a Zener diode between a display data channel pin and a transistor of said interfacing section;

turning on and off a transistor according to a presence of said display data channel connecting said transistor having a base to an output terminal of said Zener diode;

magnetizing a coil of a relay when the transistor is turned-on and first and second relay switches turned-on when said transistor is turned-off; and emitting light by a light emitting diode when said first relay switch is turned-on to identify said inputting of said display data channel.

18. A method as claimed in claim 17, with said inputting device including a mouse and a scanner and further comprising a switch to select one of said mouse and said scanner.

19. A method, comprising:

inputting a display data channel to a monitor by an inputting device;

driving said inputting device with a predetermined electric signal by a driving device;

indicating whether said display data channel of said monitor is inputted into said computer and outputting a signal according to a result of said inputting said display data channel by an interfacing section;

controlling said driving device by generating said predetermined electric signal;

analyzing said output signal from said interfacing section; and determining whether said result of said inputting said display data channel is correct, with said determining step determines that said display data channel is normally input into said computer if said interfacing section outputs a same high frequency signal as originally input as said predetermined electric signal at a first time; and said determining step determines that said display data channel is abnormally input into said computer after said interfacing section continues to output said high frequency signal at a second time.

20. A method as claimed in claim 19, with said first time being in a range of 750 milliseconds to 1.5 seconds, and said second time is in a range of 3.5 seconds to 4.5 seconds.

* * * * *